US008235840B2

(12) United States Patent
Hocknell et al.

(10) Patent No.: US 8,235,840 B2
(45) **Date of Patent: *Aug. 7, 2012**

(54) INTERCHANGEABLE SHAFT FOR A GOLF CLUB

(75) Inventors: Alan Hocknell, Carlsbad, CA (US); Matthew T. Cackett, San Diego, CA (US); Denver Holt, Carlsbad, CA (US); D. Clayton Evans, San Marcos, CA (US); Daniel M. Stevens, Cardiff, CA (US); James C. Wenck, Carlsbad, CA (US); Steven S. Ogg, Carlsbad, CA (US); Konrad Lenhof, Vista, CA (US); Jerry V. Blanke, Murrieta, CA (US); Joel B. Erickson, Pierce, NE (US); Broadus Perry Wall, Jr., Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/219,464

(22) Filed: Aug. 26, 2011

(65) Prior Publication Data

US 2011/0312434 A1 Dec. 22, 2011

Related U.S. Application Data

(60) Continuation of application No. 13/186,118, filed on Jul. 19, 2011, now Pat. No. 8,096,895, which is a continuation of application No. 13/013,656, filed on Jan. 25, 2011, now Pat. No. 8,002,644, which is a division of application No. 12/692,428, filed on Jan. 22, 2010, now abandoned, which is a division of application No. 11/928,146, filed on Oct. 30, 2007, now abandoned, which is a continuation of application No. 11/461,132, filed on Jul. 31, 2006, now abandoned, which is a continuation-in-part of application No. 10/904,581, filed on Nov. 17, 2004, now Pat. No. 7,083,529.

(51) Int. Cl.
*A63B 53/02* (2006.01)

(52) U.S. Cl. ..... 473/307; 473/309; 473/288; 473/246

(58) Field of Classification Search ..... 473/288, 473/307, 309, 244–248
See application file for complete search history.

(56) References Cited

U.S. PATENT DOCUMENTS

| | | | |
|---|---|---|---|
| 1,643,754 | A | 9/1927 | Sleith |
| 2,020,679 | A | 11/1935 | Fitzpatrick |
| 2,067,556 | A | 1/1937 | Wettlaufer |
| 2,171,483 | A | 8/1939 | Simonton |
| 3,524,646 | A | 8/1970 | Wheeler |
| 3,625,513 | A | 12/1971 | Ballmer |
| 4,854,583 | A | 8/1989 | Kobayashi |

(Continued)

*Primary Examiner* — Stephen L. Blau
(74) *Attorney, Agent, or Firm* — Rebecca Hanovice; Michael A. Catania; Sonia Lari

(57) ABSTRACT

A golf club (20) having a club head (22) with an interchangeable shaft (40) is disclosed herein. The golf club (20) includes a tube (44, 144) mounted in the club head (22), and a sleeve (46, 146) mounted on a tip end (50) of the shaft (40). The tube (44, 144) includes a tapered portion (60, 160) and a rotation prevention portion (62, 162). The sleeve (46, 146) has a frustoconical portion (72, 172) and a keyed portion (74, 174) that are respectively received in the tapered portion (60, 160) and the rotation prevention portion (62, 162) of the tube (44, 144). The golf club (20) further includes a mechanical fastener (48, 148) for removably securing the shaft (40) to the club head (22).

7 Claims, 8 Drawing Sheets

U.S. PATENT DOCUMENTS

| | | | | |
|---|---|---|---|---|
| 4,943,059 | A | 7/1990 | Morell | |
| 4,948,132 | A | 8/1990 | Wharton | |
| 5,039,098 | A | 8/1991 | Pelz | |
| 5,133,553 | A | 7/1992 | Divnick | |
| 5,184,819 | A | 2/1993 | Desbiolles | |
| 5,433,442 | A | 7/1995 | Walker | |
| 5,513,844 | A | 5/1996 | Ashcraft et al. | |
| 5,527,034 | A | 6/1996 | Ashcraft et al. | |
| 5,586,944 | A | 12/1996 | Nagamoto et al. | |
| 5,588,921 | A | 12/1996 | Parsick | |
| 5,643,104 | A | 7/1997 | Antonious | |
| 5,702,310 | A | 12/1997 | Wozny | |
| 5,722,901 | A | 3/1998 | Barron et al. | |
| 5,816,961 | A | 10/1998 | Kraemer | |
| 5,851,155 | A | 12/1998 | Wood et al. | |
| 5,863,260 | A | 1/1999 | Butler, Jr. et al. | |
| 5,885,170 | A | 3/1999 | Takeda | |
| 5,951,411 | A | 9/1999 | Wood et al. | |
| 6,149,533 | A | 11/2000 | Finn | |
| 6,273,828 | B1 | 8/2001 | Wood et al. | |
| 6,514,154 | B1 | 2/2003 | Finn | |
| 6,547,673 | B2 | 4/2003 | Roark | |
| 6,620,053 | B2 | 9/2003 | Tseng | |
| 6,620,054 | B2 * | 9/2003 | Tseng | 473/306 |
| 6,769,996 | B2 | 8/2004 | Tseng | |
| 6,966,847 | B2 | 11/2005 | Lenhof et al. | |
| 7,083,529 | B2 | 8/2006 | Cackett et al. | |
| 2004/0018886 | A1 | 1/2004 | Burrows | |
| 2004/0018887 | A1 | 1/2004 | Burrows | |
| 2005/0049072 | A1 | 3/2005 | Burrows | |

* cited by examiner

FIG. 16
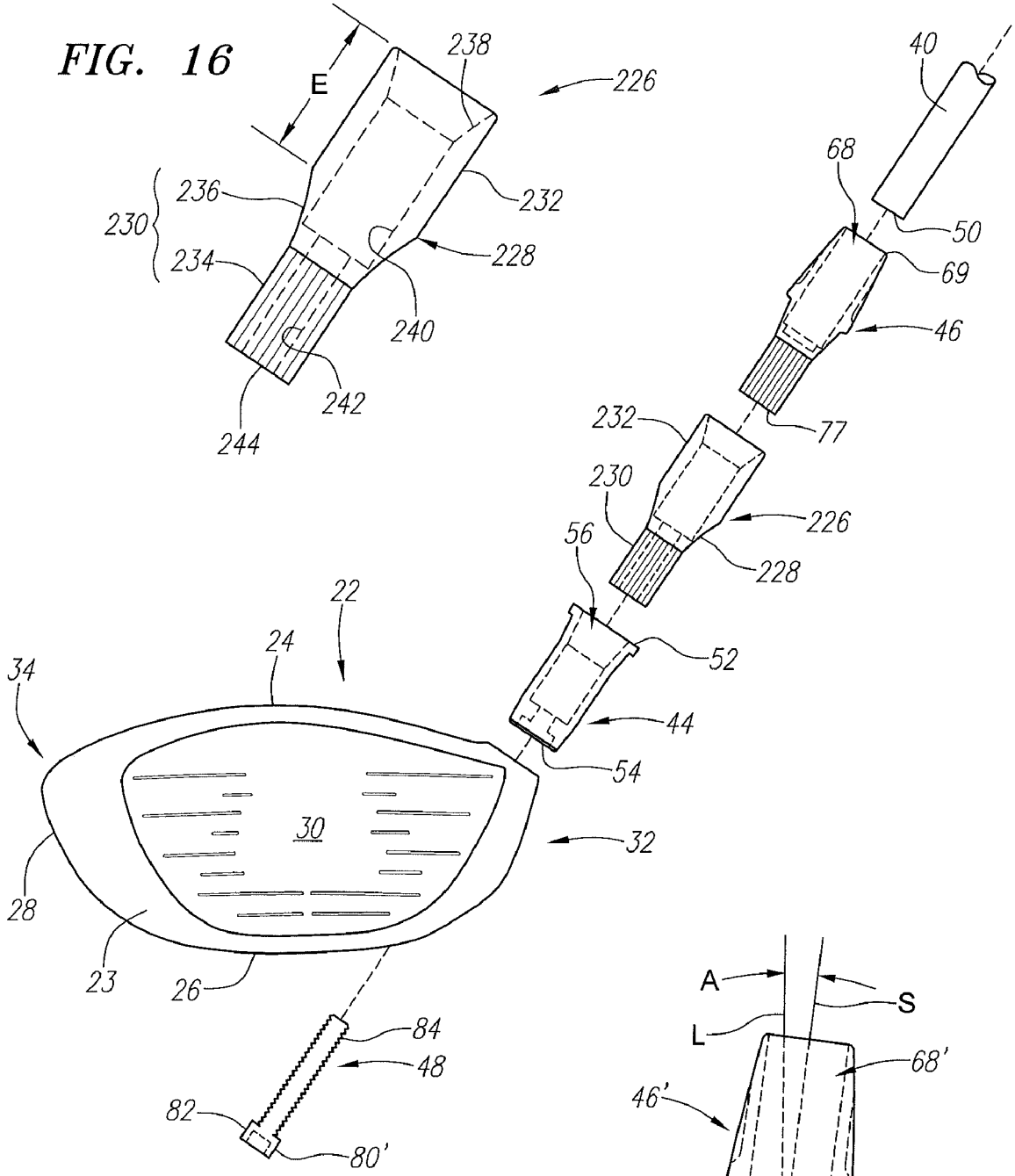
FIG. 15
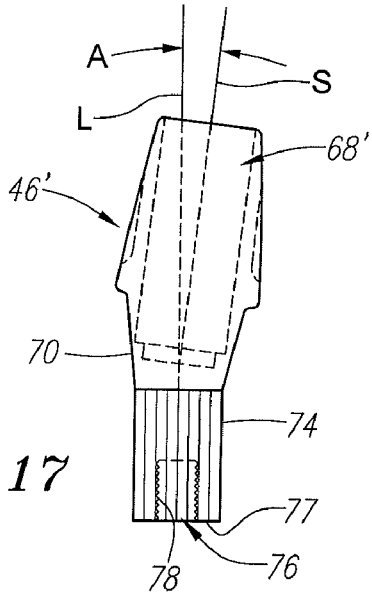
FIG. 17

INTERCHANGEABLE SHAFT FOR A GOLF CLUB

CROSS REFERENCES TO RELATED APPLICATIONS

The present invention is a continuation application of U.S. patent application Ser. No. 13/186,118, filed on Jul. 19, 2011, which is a continuation application of U.S. patent application Ser. No. 13/013,656, filed on Jan. 25, 2011, now U.S. Pat. No. 8,002,644, which is a divisional application of U.S. patent application Ser. No. 12/692,428, filed on Jan. 22, 2010, now abandoned, which is a divisional application of U.S. patent application Ser. No. 11/928,146, filed on Oct. 30, 2007, now abandoned, which is a continuation of U.S. patent application Ser. No. 11/461,132, filed on Jul. 31, 2006, now abandoned, which is a continuation-in-part of U.S. patent application Ser. No. 10/904,581, filed on Nov. 17, 2004, now U.S. Pat. No. 7,083,529.

STATEMENT REGARDING FEDERALLY SPONSORED RESEARCH OR DEVELOPMENT

Not. Applicable

BACKGROUND OF THE INVENTION

1. Field of the Invention

The present invention relates to a golf club having an improved connection for interchanging a shaft with a golf club head.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

Two further examples are published applications to Burrows, U.S. Publication Numbers 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, they require that the golf club head have a conventional hosel for attachment. Second, these connections add excessive weight to the club head, thereby minimizing the amount of discretionary mass that may be distributed in the club head to optimize mass properties.

BRIEF SUMMARY OF THE INVENTION

The present invention provides an improved club head-shaft connection for cost-effective customization of golf clubs, while providing golfers with golf clubs that provide optimal performance. The connection, which does not require the club head to have a conventional hosel, enables quick and reliable assembly and disassembly of a shaft from the club head. In addition, the head-shaft connection of the present golf club provides a larger faying surface between the components without adding excessive weight. The reduced weight of the present connection enables more discretionary mass to be distributed to favorable locations in the club head to enhance its performance.

One aspect of the present invention is an interchangeable shaft for connection to a golf club head. The interchangeable shaft includes a shaft body and a sleeve. The sleeve, which is mounted on the tip end of the shaft body, has a lower section that includes a frustoconical portion, a keyed portion and a lower end of the sleeve. The frustoconical portion of the sleeve extends along at least one eighth of the length of the lower section. The sleeve is adapted to be mounted in a tube in the golf club head, such that the frustoconical portion of the sleeve is received in a tapered portion of the tube, and the keyed portion of the sleeve is received in a rotation prevention portion of the tube to prevent rotation of the shaft relative to the golf club head. The interchangeable shaft may be secured to the golf club head using a mechanical fastener.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 15 is an exploded perspective view of the golf club of FIG. 1 including an adapter sleeve to increase the length of the golf club.

FIG. 16 is an enlarged plan view of the adapter sleeve shown in FIG. 15.

FIG. 17 is an enlarged cross-sectional view of still another alternative sleeve.

DETAILED DESCRIPTION OF THE INVENTION

Figure 1:
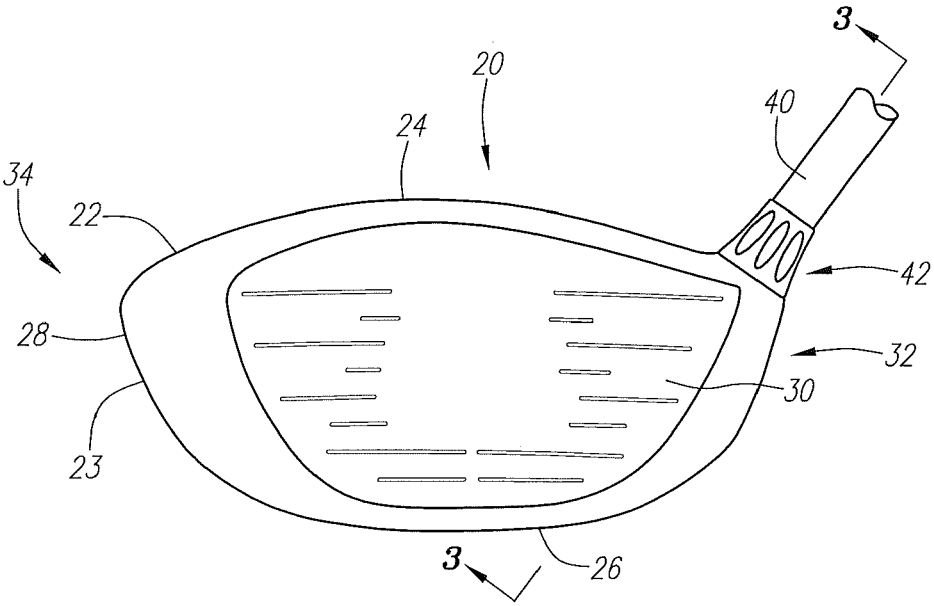
FIG. 1 is a front plan view of a golf club in accordance with one embodiment of the present invention.
Figure 2:
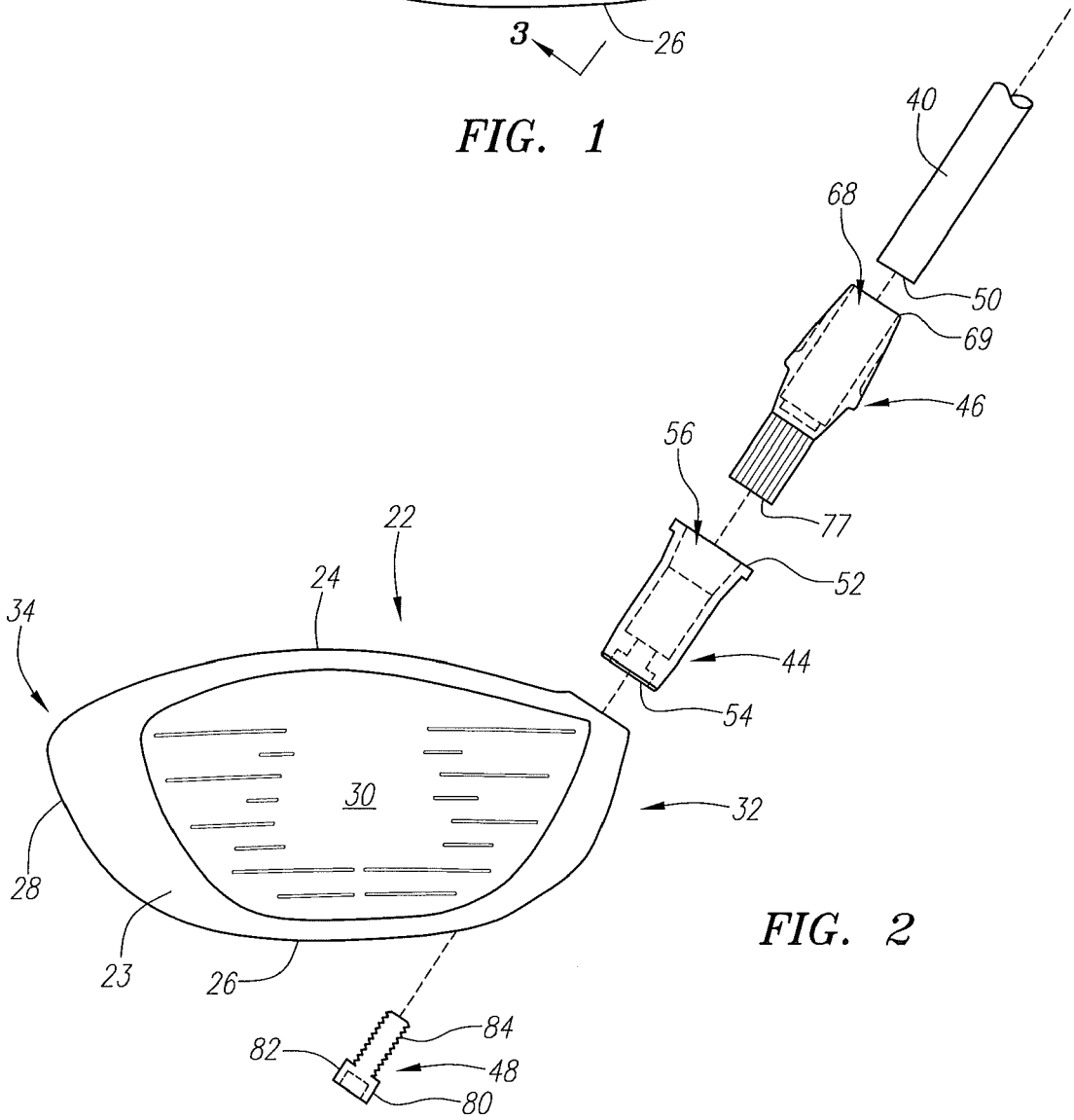
FIG. 2 is an exploded perspective view of a portion of the golf club of FIG. 1 illustrating the components of the head-shaft connection, including a sleeve, a tube, and a mechanical fastener.

As shown in FIGS. 1 and 2, a golf club is generally designated 20. The golf club 20 has a club head 22 and a shaft 40 that is coupled to the club head 22. The club head 22 is a wood-type golf club head with a body 23 having a crown, 24, a sole 26, a ribbon 28 and a striking plate 30. The striking plate 30 generally extends along the front of the club head 22 from a heel end 32 to a toe end 34. The club head body 23 preferably has a hollow interior with an internal hosel 31 (FIG. 3) for receiving the tip end of the shaft 40.

The body 23 is preferably composed of a metallic material, such as titanium, titanium alloy, stainless steel, or the like. Alternatively, the body 23 may be composed of multiple materials, such as a titanium face cup attached to a carbon composite body. The body 23 has a large volume, preferably greater than 300 cubic centimeters, and weighs no more than 215 grams, more preferably between 180 and 215 grams. Although the club head 22 illustrated is a wood-type club head, the club head 22 may also be an iron-type or putter-type club head.

The shaft 40 is preferably composed of a graphite material, however, it may be composed of a metallic material, such as stainless steel or titanium. Alternatively, the shaft 40 may be composed of a hybrid of graphite and metal. The shaft 40 preferably weighs between 40 grams and 80 grams, more preferably between 50 grams and 75 grams, and is most preferably 65 grams.

The shaft 40 is coupled to the club head 22 using a connection 42 that provides for easy assembly, disassembly and reassembly, thereby facilitating customization of the golf club 20. In a preferred embodiment of the invention illustrated in FIGS. 2 and 3, the connection 42 includes a tube 44, a sleeve 46 and a mechanical fastener 48. The sleeve 46 is mounted on a tip end 50 of the shaft 40. The shaft 40 with the sleeve 46 mounted thereon is then inserted in the tube 44, which is mounted in the club head 22. The mechanical fastener 48 secures the sleeve 46 to the tube 44 to retain the shaft 40 in connection with the club head 22.

The tube 44 is preferably composed of a metallic material, such as aluminum or titanium, but may also be composed of a suitable non-metallic material. Titanium alloys, such as 6-4 titanium, 10-2-3 titanium, 15-3-3-3 titanium and the like, and newly developed aluminum alloys, such as 7055-T174, 7055-T76, C405-T6, C805-T6 and the like, are stronger and tougher than 7075 aluminum and allow the structural integrity (e.g., durability, resistance to breakage) of the tube 44 to be further enhanced without adding weight. If the tube 44 is composed of a titanium alloy, its minimum wall thickness may be in the range of 0.015 inch to 0.020 inch. If the tube 44 is composed of an aluminum alloy, its minimum wall thickness may be slightly larger, at 0.025 inch, but will have improved resistance to cracking. The tube 44 is preferably treated with an anodizing or tiodizing process to improve the surface hardness and wear resistant properties of the tube 44. The tube 44 may be separately machined, cast or metal injection molded and secured in the internal hosel 31 of the club head 22 using an adhesive, such as epoxy. Alternatively, the tube 44 may be integrally cast or formed with the body 23 of the club head 22. The tube 44 has an upper end 52 that is substantially flush with the exterior surface of the crown 24 of the club head 22 and a lower end 54 that extends toward, but not all the way down to, the sole 26 of the club head 22. An opening 56 extends through the tube 44 from the upper end 52 to the lower end 54 and aligns with an opening 58 in the sole 26.

Figure 3:
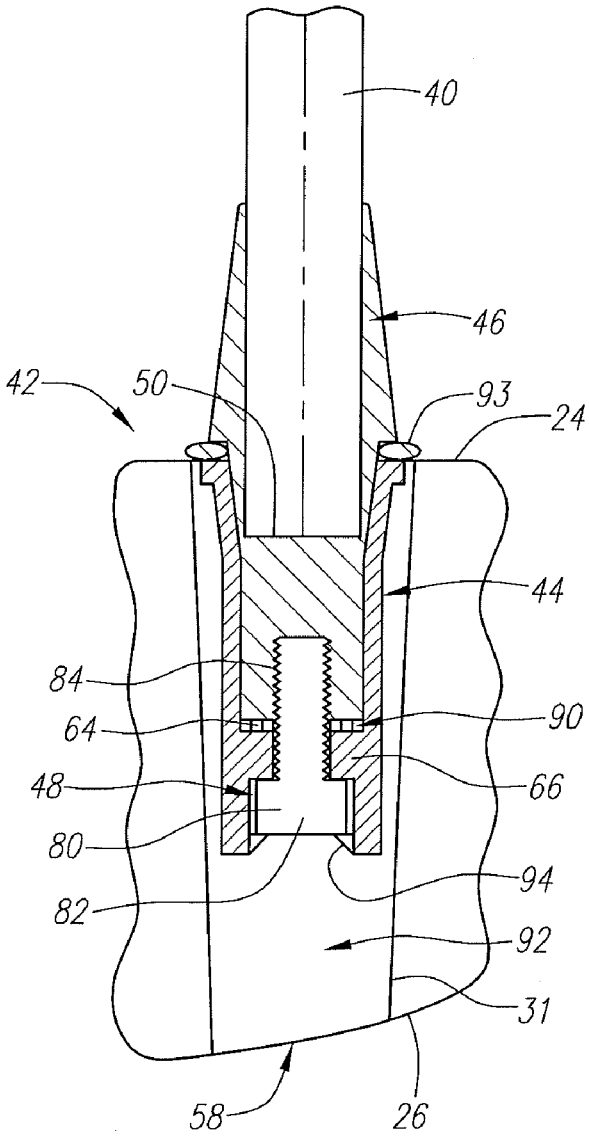
FIG. 3 is an enlarged cross-sectional view taken generally along the line 3-3 in FIG. 1.
Figure 4:
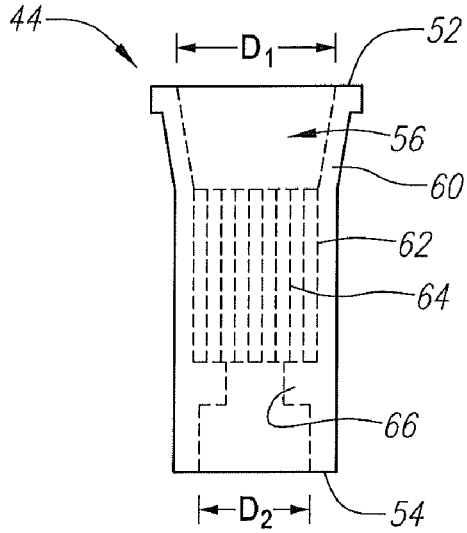
FIG. 4 is an enlarged cross-sectional view of the tube shown in FIG. 2.

As best illustrated in FIG. 4, the tube 44 includes a tapered portion 60 and a rotation prevention portion 62. The tapered portion 60 is located proximate the upper end 52 of the tube 44 and provides a contact surface for receiving the sleeve 46, as will be described in greater detail below. The upper end 52 of the tube 44, therefore, has an inner diameter $D_1$ that is larger than an inner diameter $D_2$ of the lower end 54. The rotation prevention portion 62, which is preferably located below the tapered portion 60, defines a keyway for receiving a portion of the sleeve 46. The keyway has a non-circular cross-section to prevent rotation of the sleeve 46 relative to the tube 44. The keyway may have a plurality of splines 64, as illustrated in FIGS. 3 and 4, or a rectangular or hexagonal cross-section.

The tube 44 further includes a flange 66 that projects radially inward from the sidewall of the tube 44. In the preferred embodiment, the flange 66 is located below the rotation prevention portion 62. The flange 66 provides a surface against which a portion of the mechanical fastener 48 rests. The flange 66 extends into the opening 56 a sufficient distance to prevent the entire mechanical fastener 48 from passing through, while allowing a portion of the mechanical fastener 48 to extend into the rotation prevention portion 62.

Figure 5:
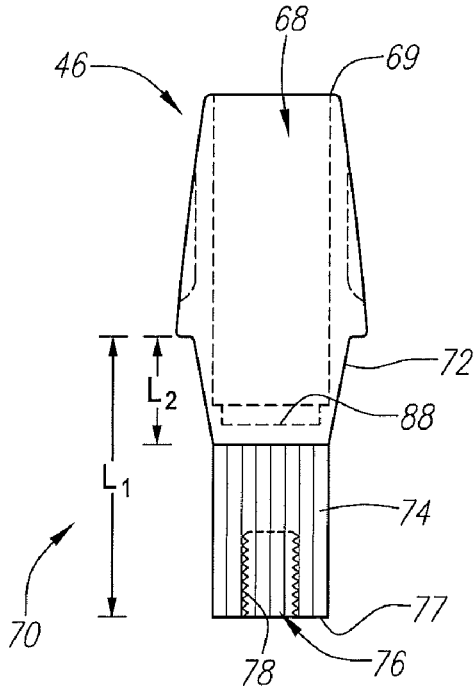
FIG. 5 is an enlarged cross-sectional view of the sleeve shown in FIG. 2.
Figure 10A:
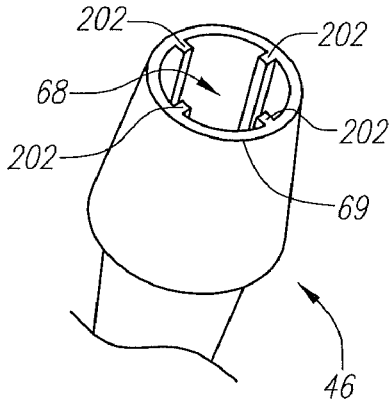
FIGS. 10A-10C are enlarged, partial perspective views of alternative sleeves, illustrating various features that may be provided to help center a shaft in the opening of the sleeve.
Figure 10D:
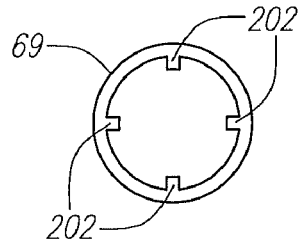
FIGS. 10D-10F are top plan views of the alternative sleeves shown in FIGS. 10A-10C, respectively.
Figure 10B:
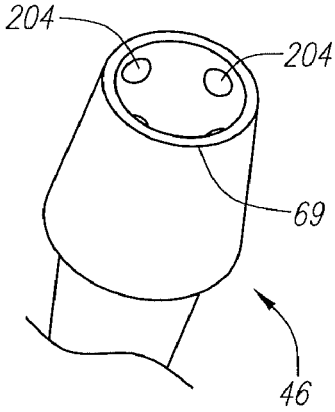
Figure 10E:
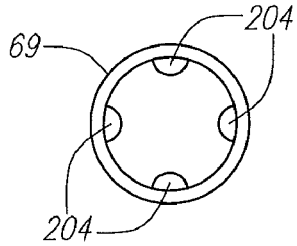
Figure 10C:
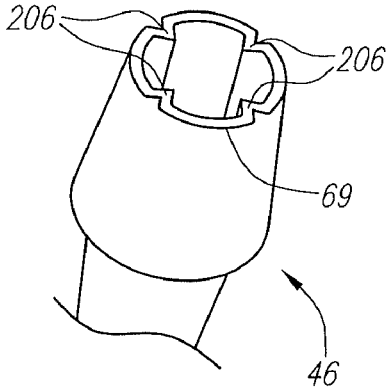
Figure 10F:
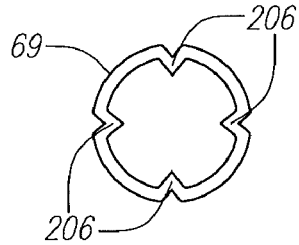

The sleeve 46, which is best illustrated in FIG. 5, has an opening 68 formed in an upper end 69 thereof for receiving the tip end 50 of the shaft 40. The sleeve 46 is fixedly secured to the shaft 40 using an adhesive, such as epoxy. As illustrated in FIGS. 10A-10F, the opening 68 in the upper end 69 of the sleeve 46 may be provided with various features that extend into the opening 68 to help center the shaft 40. Examples of such features include ribs 202 (FIGS. 10A and 10D), bumps 204 (FIGS. 10B and 10E) or crimps 206 (FIGS. 10C and 10F). Preferably these features are nominally 0.004 inch proud of the opening's inner diameter, thereby enabling a shaft to be centered in the opening 68 of the sleeve 46 without impeding the application or venting of the adhesive.

Figure 11A:
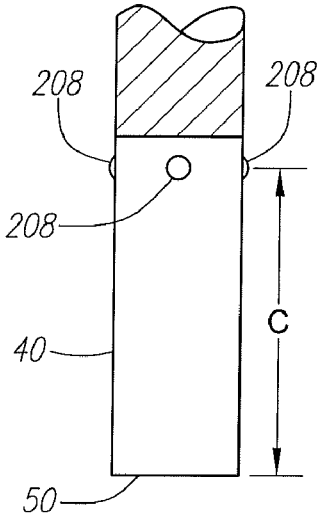
FIGS. 11A-11C are plan views of the tip end of alternative shafts having various features to help center the shaft in the opening of the sleeve.
Figure 11B:
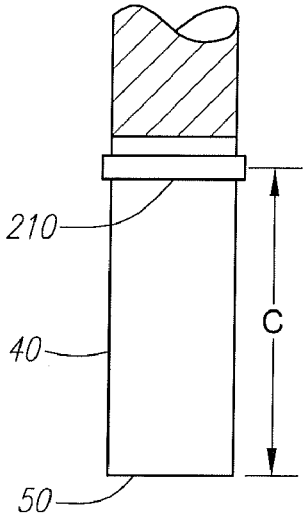
Figure 11C:
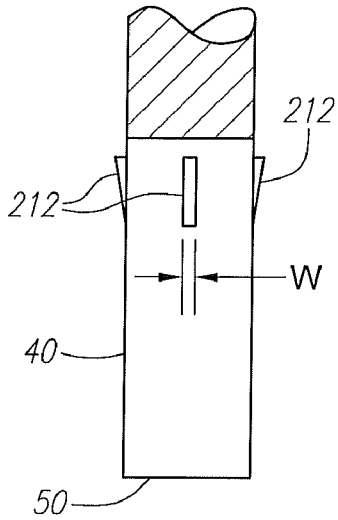

Alternatively, as illustrated in FIGS. 11A-11C, features may be provided about the outer circumference of the shaft 40 proximate the tip end 50 to help center the shaft without impeding application and venting of the adhesive. Features may include bumps 208 (FIG. 11A), a partial or completely continuous circumferential strip 210 about the circumference of the shaft 40 (FIG. 11B), or tapered axial strips 212 (FIG. 11C). As few as three bumps 208, 204 and as many as eight bumps 208, 204 may be disposed about the circumference proximate the tip end 50 of the shaft 40 or within the opening 68 of the sleeve 46. The bumps 204, 208 may have a diameter in the range of 0.03 inch to 0.12 inch and a height in the range of 0.002 inch to 0.006 inch. The bumps 208 on the shaft 40 are preferably located a distance C of between 0.7 inch and 1.3 inches from the tip end 50 of the shaft 40. Similarly, the circumferential strip 210 is located the distance C from the tip end 50 of the shaft 40 and has a width in the range of 0.03 inch and 0.12 inch and a height in the range of 0.002 inch to 0.006 inch. Between three and eight tapered axial strips 212, like bumps 208, are situated about the circumference proximate the tip end 50 of the shaft 40. Each tapered axial strip 212 has a length in the range of 0.1 inch and 0.5 inch and a width W of 0.03 inch to 0.12 inch. The thickness of each tapered axial strip 212 decreases in the direction of the tip end 50 of the shaft 40.

The sleeve 46 has a lower section 70 that includes a frustoconical portion 72 and a keyed portion 74. The lower section 70 has a length $L_1$ that is preferably between 0.60 inch and 1.0 inch, more preferably between 0.75 inch and 0.90 inch. The frustoconical portion 72 of the sleeve 46 is received in the tapered portion 60 of the tube 44 when the shaft 40 is coupled to the club head 22. The frustoconical portion 72 preferably has a length $L_2$ that is at least one eighth of the length $L_1$ of the lower section 76, more preferably at least one sixth of the length $L_1$. This region is the compressive load path between the shaft 40 and the club head 22. Because of the large contact area between the frustoconical portion 72 and the tapered portion 60, there are less localized stresses, and the connection 42 is better able to react to bending moments than prior art connections. In addition, one or both of the surfaces of the tapered portion 60 and the frustoconical portion 72 may be coated with an elastomeric material or other soft, thin material to enhance an even load distribution.

The keyed portion 74 of the sleeve 46 has a configuration that is complementary to the keyway of the rotation prevention portion 62 of the tube 44. Thus, in FIG. 5, the keyed portion 74 has a splined configuration, with splines having a maximum length of approximately 0.5 inch. Alternatively, the keyed portion 74 may have a rectangular or hexagonal configuration, similar to that of the corresponding keyway.

The sleeve 46 has a second opening 76 formed in a lower end 77 thereof. The opening 76 is formed with internal threads 78 for engagement with external threads on the mechanical fastener 48. The sleeve 46 is preferably composed of a metallic material, such as aluminum or titanium. The sleeve 46 is preferably treated with an anodizing or tiodizing process to improve the surface hardness and wear resistant properties of the sleeve 46, particularly if the sleeve 46 is composed of a dissimilar material than the tube 44. For example, if the sleeve 46 is composed of titanium and the tube 44 is composed of aluminum, an ALUMAZITE® coating manufactured by Tiodize Co., Inc. may be applied to the frustoconical portion 72 and the keyed portion 74 of the sleeve 46 to prevent galvanic corrosion between the aluminum sleeve and the titanium tube. Alternatively, the sleeve 46 may be composed of a reinforced injection molded plastic, such as polyphthalamide (PPA) with 40-60% carbon fiber (preferably long fibers), which may offer weight savings over 7075 aluminum.

A steel liner with internal threads (not shown) may be provided in the opening 76 for improved wear. Such a steel liner may include a HELI-COIL screw thread insert from Emhart Teknologies or a KEENSERTS insert from Alcoa Fastening Systems.

Figure 12:
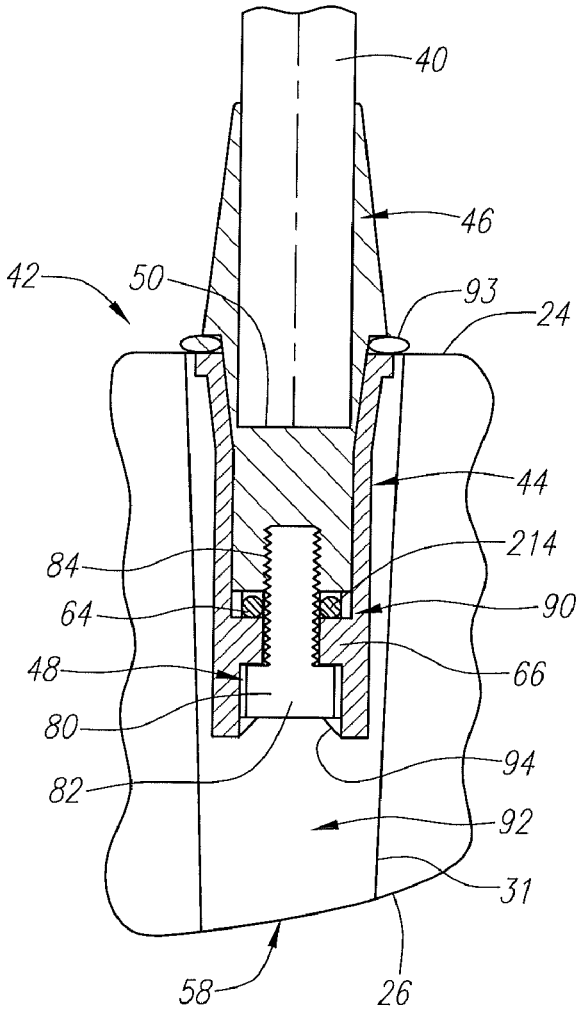
FIG. 12 is similar to FIG. 3 but includes an O-ring to help retain the screw.

Assembly of the golf club 20 includes permanently securing the tube 44 to the club head 22, and the sleeve 46 to the tip end 50 of the shaft 40. The tip end 50 of the shaft 40 with the sleeve 46 mounted thereon is then inserted into the opening 56 of the tube 44, such that the keyed portion 74 of the sleeve 46 engages the keyway of the tube's rotation prevention portion 62, and the frustoconical portion 72 is in contact with the tapered portion 60. The mechanical fastener 48 is then connected to the sleeve 46. The mechanical fastener 48 is preferably composed of steel, titanium or aluminum. As shown in FIGS. 2 and 3, the mechanical fastener 48 is a screw, such as a socket screw 80 having a socket head 82 and external threads 84. The external threads 84 of the socket screw 80 may be conventional single lead threads or, alternatively, multi-lead threads of two, three or four parallel threads (not shown). Multi-lead threads enable the threaded connection to be assembled or disassembled more quickly, while still engaging a sufficient number of threads to secure the connection. The socket screw 80 is inserted into the lower end 54 of the tube 44 through the opening 58 in the sole 26 of the club head 22. The external threads 84 of the socket screw 80 engage the internal threads 78 in the opening 76 at the lower end 77 of the sleeve 46, while the socket head 82 abuts the flange 66 of the tube 44. An anti-vibration lock-washer (not shown) may be provided between the socket head 82 and the flange 66 to prevent loosening or rattling of the socket screw 80. Alternatively, as shown in FIG. 12 a clip or an O-ring 214 may be applied to the threaded end of the socket screw 80 after insertion of the socket screw 80 into the tube 44 and prior to insertion of the sleeve 46. The O-ring 214 decreases the likelihood that the socket screw 80 will inadvertently loosen, disengage from the tube 44 and fall out of the club head 22.

Because the tube 44 and the sleeve 46 are composed of lightweight materials, the connection 42 does not add unnecessary weight to the golf club 20. Further, voids between the various components exist to further reduce weight from this region of the club head 22. A first void 90 is located between the lower end 77 of the sleeve 46 and the flange 66 of the tube 44. A second void 92 is located between the mechanical fastener 48 and the lower end 54 of the tube 44. The voids 90 and 92 decrease the weight of connection 42, thereby providing more discretionary mass that may be distributed to favorable positions along club head 22. In an alternative embodiment illustrated in FIG. 13, no portion of the shaft 40 extends into the interior volume of the club head 22 or the hosel 31.

Thus, the tip end 50 of the shaft 40 terminates at or above the furthest extent of the hosel 31, and a third void 216 may be located in the sleeve 46 below the tip end 50 of the shaft 40 for further weight reduction. The sleeve 46 bridges the gap between the club head 22 and the shaft 40.

The golf club 20 may further include a sealing gasket 93, such as an O-ring, to prevent the ingress of water, dirt or other contaminants into the connection 42. This is important, since the club head 22 may be submerged in water for purposes of cleaning. Without the sealing gasket 93, water could enter into the threaded joint and result in corrosion or freezing of the threads.

Figure 13:
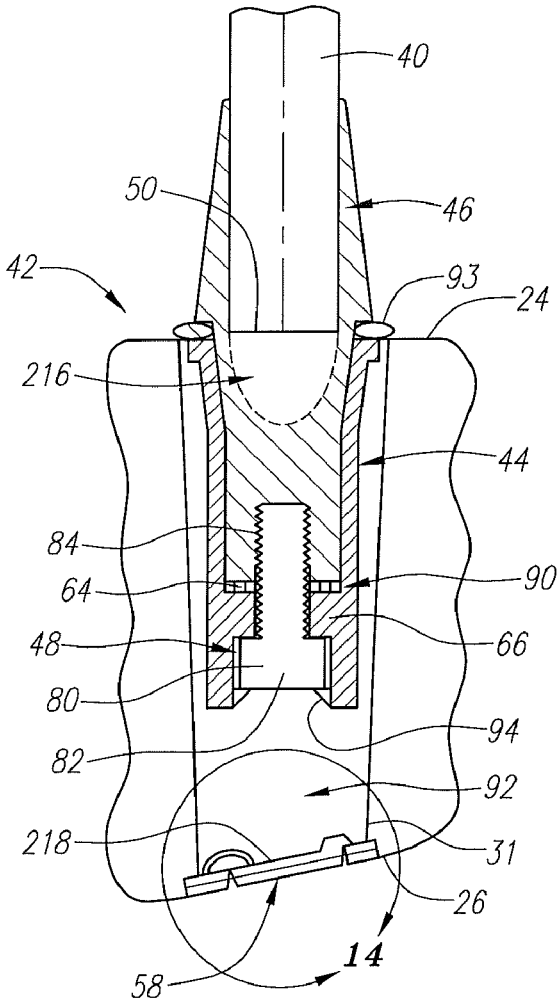
FIG. 13 is similar to FIG. 3 except that the shaft does not extend into the interior volume of the club head, and the club head includes a cap covering the opening in the sole.
Figure 14A:
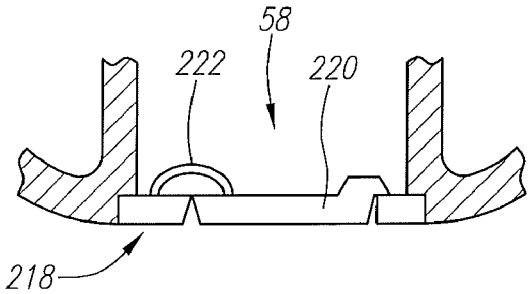
FIG. 14A is an enlarged sectional view taken generally along 14-14 of FIG. 13 showing the hinged flap of the cap in the closed position.
Figure 14B:
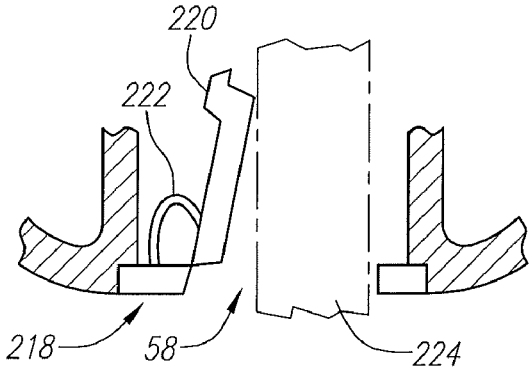
FIG. 14B is an enlarged sectional view showing the hinged flap of the cap in an open position.

As illustrated in FIGS. 13, 14A and 14B, the opening 58 in the sole 26 of the club head 22 may also be provided with a cap 218. The cap 218, which includes a flap 220 and a live hinge 222, is bonded to the sole 26 of the club head 22 to inhibit ingress of dust and debris into the opening 58 during use. The live hinge 222 yields and retracts when a drive tool 224 (FIG. 14B), allowing access to the socket screw 80. Preferably, the cap 218 and the live hinge 222 are injection molded as a single part and then bonded into the opening 58 of the club head 22 using an adhesive.

The head-shaft connection 42 allows the shaft 40 to be detached from the club head 22 and replaced with a different shaft. To disassemble the golf club 20, the socket screw 80 is unscrewed from the sleeve 46 and removed through the opening 58 in the sole 26 of the club head 22. The shaft 40 and sleeve 46 may then be lifted out of the upper end 52 of the tube 44 and separated from the club head 22. A second shaft and sleeve assembly may then be coupled to the club head 22.

When a suitable club head and shaft combination is achieved, the connection 42 may be made more permanent by applying a bead 94 of adhesive about the head 82 of the socket screw 80. This adhesive bead 94 would prevent the average golfer from disassembling the golf club 20 and interchanging components, thereby enabling the golf club 20 to conform to the USGA and R&A rules of golf. A skilled golf repair technician, however, would still be able to disassemble the golf club by applying heat locally to the joint. One of ordinary skill in the art will appreciate that alternatives to the adhesive bead 94 may also be employed. One example is an adhesive washer that is applied between the screw head 82 and the flange 66. Another example is a sleeve of adhesive that is applied about the surface of the screw head 82, thereby bonding the socket screw 80 to the interior surface of the tube 44. Still another example is a plug that is inserted into the opening 56 after the socket screw 80. The plug, which engages the screw's socket, is the bonded to interior surface of the tube 44 using an adhesive.

FIGS. 6-9 illustrate a golf club with an alternative connection 142 for joining a shaft 40 to a club head 22. The connection 142 includes a tube 144, a sleeve 146 and a mechanical fastener 148. The mechanical fastener 148 is a compression nut 96 having external threads 98. The compression nut 96 and the sleeve 146 are placed on the shaft 40, with the sleeve 146 mounted on the tip end 50 and secured thereto with an adhesive, such as epoxy. The shaft 40 with the sleeve 146 and compression nut 96 thereon is then inserted into the tube 144, which is mounted in the club head 22. The compression nut 96 is then tightened to engage the tube 144, thereby securing the sleeve 146 inbetween and connecting the shaft 40 to the club head 22.

The tube 144 is preferably composed of a metallic material, such as aluminum or titanium, but may also be composed of a suitable non-metallic material. Titanium alloys, such as 6-4 titanium, 10-2-3 titanium, 15-3-3-3 titanium and the like, and newly developed aluminum alloys, such as 7055-T174, 7055-T76, C405-T6, C805-T6 and the like, are stronger, tougher than 7075 aluminum and allow the structural integrity (e.g., durability, resistance to breakage) of the tube 144 to be further enhanced without adding weight. If the tube 144 is composed of a titanium alloy, its minimum wall thickness may be in the range of 0.015 inch to 0.020 inch. If the tube 144 is composed of an aluminum alloy, its minimum wall thickness may be slightly larger, at 0.025 inch, but will have improved resistance to cracking. The tube 144 may be separately machined, cast or metal injection molded and secured in the internal hosel 31 of the club head 22 using an adhesive, such as epoxy. Alternatively, the tube 144 may be integrally cast or formed with the body 23 of the club head 22. The tube 144 has an upper end 152 that extends above the crown surface 24 of the club head 22. Alternatively, the upper end 152 of the tube 144 may be flush with the crown surface 24. An opening 156 extends along a majority of the length of the tube 144 from the upper end 152 toward a lower end 154. The lower end 154 of the tube 144, however, is closed. The inner diameter $D_1$ of the upper end 152 of the tube 144 is greater than the inner diameter $D_2$ at the lower end 154.

Figure 8:
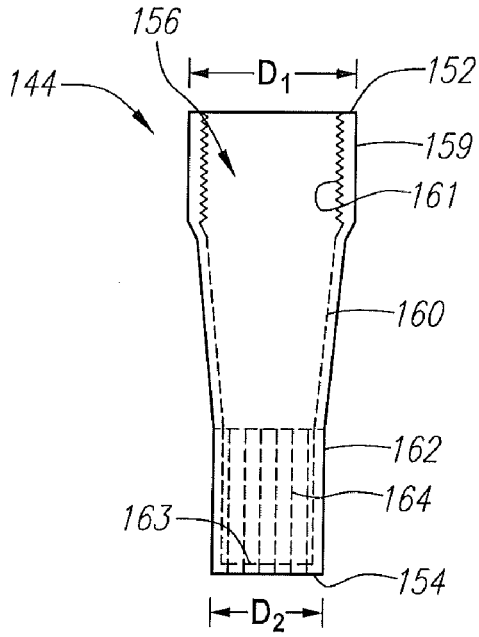
FIG. 8 is an enlarged cross-sectional view of the tube shown in FIG. 6.

The tube 144, as illustrated in FIG. 8, includes a connection portion 159, a tapered portion 160 and a rotation prevention portion 162. The connection portion 159 is located proximate the upper end 152 of the tube 144 and has internal threads 161 for engaging the external threads 98 of the compression nut 96. Because the threads 161 of tube 144 are internal, the threads 161 are protected from damage that may occur during storage, manufacture, or customization of the golf club 20.

The tapered portion 160, which provides a contact surface for receiving the sleeve 146, is located below the connection portion 159. The rotation prevention portion 162 is located proximate the lower end 154 of the tube 144 and defines a keyway for receiving a portion of the sleeve 146. As with the previous embodiment, the keyway has a non-circular cross-section to prevent rotation of the sleeve 146 relative to the tube 144. The keyway of the rotation prevention portion 162 illustrated in FIGS. 7 and 8 is provided with splines 164.

Figure 9:
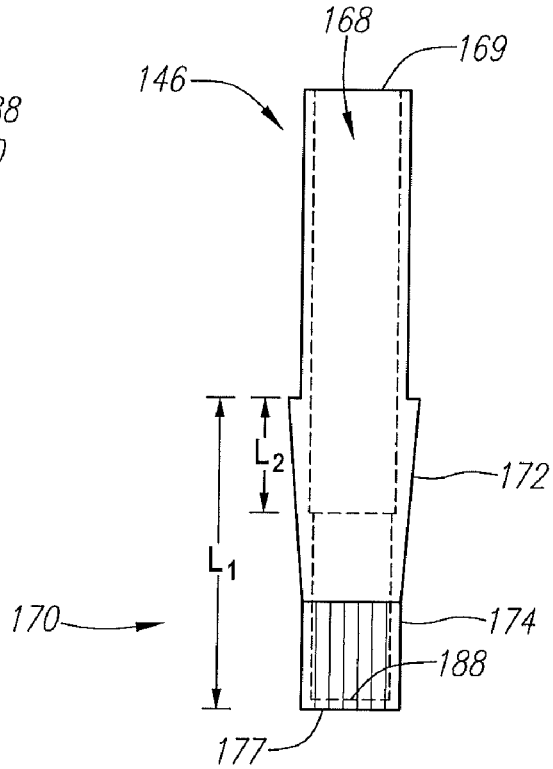
FIG. 9 is an enlarged cross-sectional view of the sleeve shown in FIG. 6.

The sleeve 146 is illustrated in FIG. 9. The sleeve 146 has an opening 168 formed in an upper end 169 thereof for receiving the tip end 50 of the shaft 40. The sleeve is fixedly secured to the shaft 40 using an adhesive, such as epoxy. As discussed earlier with respect to FIGS. 10A-10F and 11A-11C, either the sleeve 146 or the shaft 40 may further be provided with features to help center the shaft 40 in the opening 168 of the sleeve 146. The sleeve 146 has a lower section 170 that includes a frustoconical portion 172 and a keyed portion 174. The frustoconical portion 172 has a length $L_2$ that is at least one eighth of the length $L_1$ of the lower section 170, more preferably at least one sixth of the length $L_1$. The keyed portion 174 of the sleeve 146 is configured to complement the keyway of the tube's rotation prevention portion 162. Thus, the illustrated keyed portion 174 has a splined configuration, with splines having a maximum length of approximately 0.5 inch.

Figure 6:
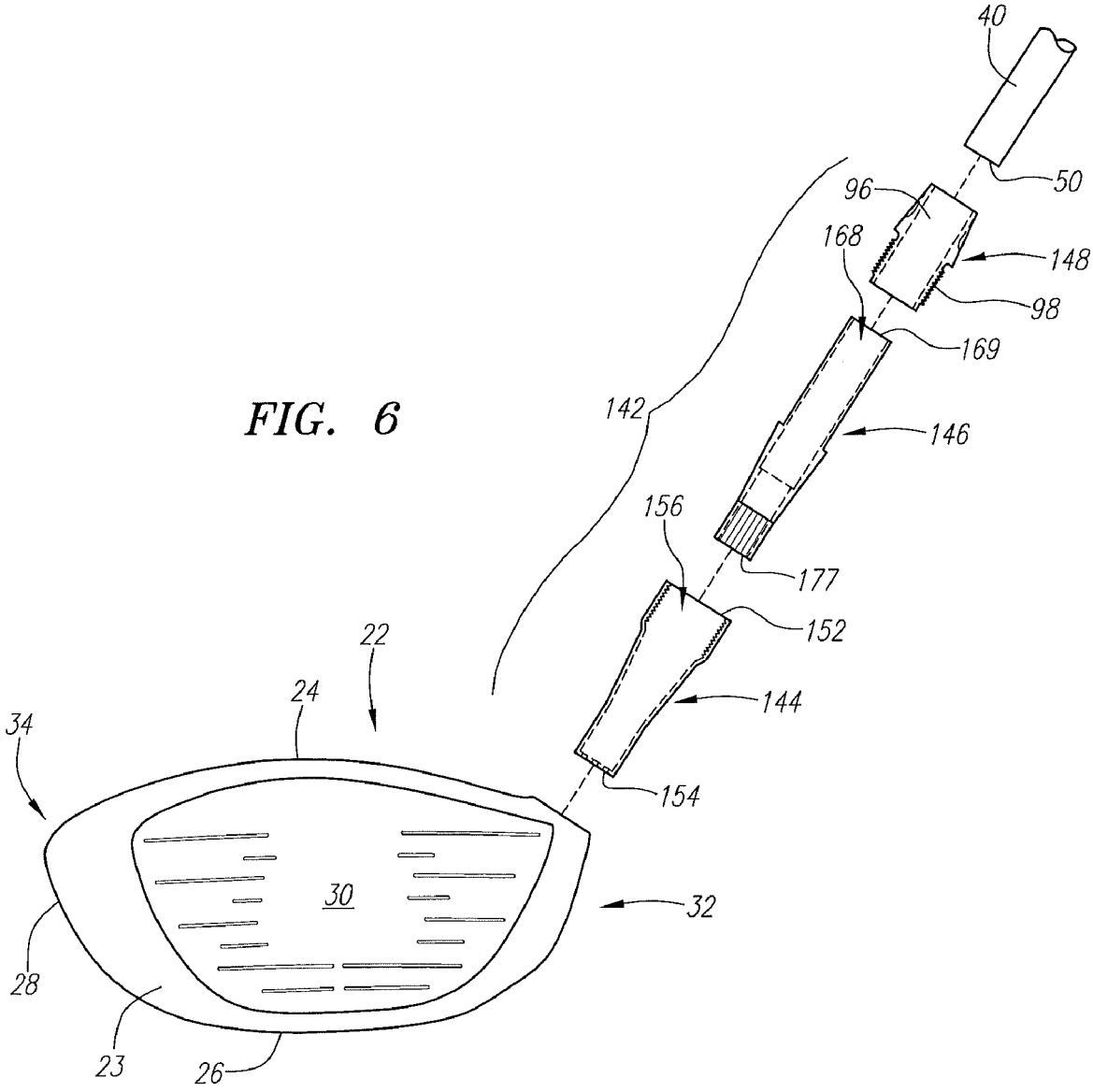
FIG. 6 is an exploded perspective view of a portion of a golf club in accordance with another embodiment of the present invention.
Figure 7:
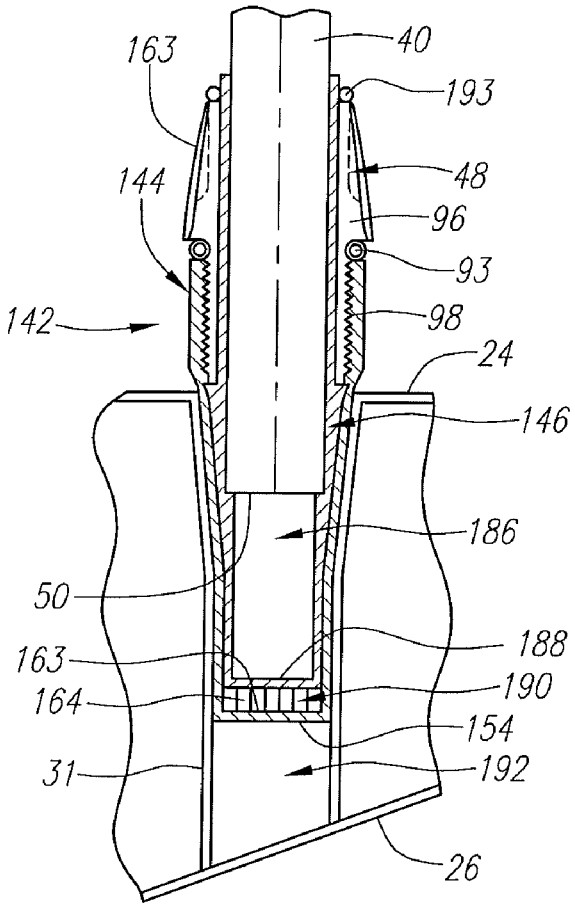
FIG. 7 is an enlarged cross-sectional view similar to FIG. 3, but of the golf club of FIG. 6.

The golf club illustrated in FIGS. 6 and 7 is assembled by permanently securing the tube 144 to the club head 22. Next, the compression nut 96 is placed over the tip end 50 of the shaft 40. The sleeve 146 is then permanently secured to the tip end 50 of the shaft 40. The tip end 50 of the shaft 40, carrying the sleeve 146 and the compression nut 96, is then inserted into the opening 156 in the tube 144, such that the keyed portion 174 of the sleeve 146 engages the keyway of the tube's rotation prevention portion 162, and the frustoconical portion 172 is in contact with the tapered portion 160. The external threads 98 of the compression nut 96 are then engaged with the internal threads 161 of the connection portion 159 of the tube 144 to secure the shaft 40 to the club head 22.

As with the previous embodiment, the tube 144 and the sleeve 146 are composed of lightweight materials, such as aluminum or titanium, that do not add unnecessary weight to the golf club. If the sleeve 146 and the tube 144 are composed of different materials, such as titanium and aluminum, respectively, the sleeve 146 may be coated with an ALUMAZITE® coating to prevent galvanic corrosion between the aluminum sleeve and the titanium tube. In addition, voids are provided in the connection 142 to further reduce weight from this region of the club head 22. A first void 186 is located between the tip end 50 of the shaft 40 and a bottom surface 168 of the opening 188 in the sleeve 146. A second void 190 is located between the lower end 177 of the sleeve 146 and a bottom surface 163 of the opening 156 in the tube 144. A third void 192 is located between the lower end 154 of the tube 144 and the sole 26 of the club head 22.

The golf club may further include a sealing gasket 93 located between the compression nut 96 and the upper end 152 of the tube 144 to prevent water and other contaminants from entering the connection 142. A second gasket 193 may also be provided between the top of the compression nut 96 and the upper end 169 of the sleeve 146 for aesthetic purposes.

When a suitable head and shaft combination is achieved, the connection 142 may be made more permanent, by applying a cover 163 over the exposed portion of the compression nut 96. The cover 163 is preferably a thin sheath of rubber or elastomeric material that encloses the indents on the compression nut 96, making the compression nut 96 inaccessible to the average golfer. The cover 163 may be integral with the sealing gaskets 93 and 193 or separate. The connection 142 may also be made more permanent by extending the lower edge of the head of the compression nut 96 over the sealing gasket 93 to overlap the outer wall of the upper end 152 of the tube 144, and applying a bead of adhesive at the overlap. Local application of heat to this joint by a skilled golf repair technician would enable the compression nut 96 to be separated from the tube 144 and a different shaft to be combined with the club head.

The connections 42 and 142 may also be provided with an adapter sleeve to enable the fitting system to accommodate additional club lengths over the standard club length. For example, as illustrated in FIG. 15, the connection 42 may include an adapter sleeve 226 to increase the resulting golf club's length by 0.5 inch or 1.0 inch. The adapter sleeve 226 is preferably composed of a lightweight material, such as aluminum, titanium or a reinforced injection molded plastic. The adapter sleeve 226, best illustrated in FIG. 16, includes a body 228 that has a lower portion 230 and an exposed spacer portion 232 extending above the lower portion 230. The lower portion 230 of the adapter sleeve 226 is configured to fit into the tube 44 and includes a frustoconical portion 234 and a keyed portion 236, which mate respectively with the tapered portion 60 and the rotation prevention portion 62 of the tube 44. The exposed spacer portion 232 of the adapter sleeve 226 has a length E preferably in the range of 0.5 inch to 1.0 inch to increase the length of the golf club. The spacer portion 232 of the adapter sleeve 226 has an internal tapered portion 238 and a rotation prevention portion 240 for respectively receiving the frustoconical portion 72 and the keyed portion 74 of the sleeve 74. A bore 242 formed in a bottom end 244 of the adapter sleeve 226 extends through the adapter sleeve 226 to allow a longer socket screw 80' to pass through the adapter sleeve 226 and engage the sleeve 46. The that has tapered, splined and threaded interfaces that match the interfaces of the standard sleeve 46 and the hosel tube 44.

In still another embodiment of the present invention, the sleeve may be angled such that when the golf club is assembled, the axis of the shaft 40 is not aligned with the axis of the internal hosel 31. As illustrated in FIG. 17 a sleeve 46' has an opening 68' for receiving the shaft 40. The opening 68' has an axis S that is off-angle from an axis L of the lower section 70 of the sleeve 46, and therefore off-angle with the axis of the internal hosel 31 of the club head 22. The angle A between the axis S and the axis L is preferably between 1° and 5°. With this arrangement, when the subassembly that includes the shaft 40 and the sleeve 46 is rotated, the effective loft, lie and face angle of the golf club may be adjusted.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club having an interchangeable shaft for connection to a golf club head, the golf club comprising:

a shaft comprising a shaft body with a tip end;

a golf club head comprising a face, a sole, a crown and an interior hosel having an opening extending from a crown to a sole;

a sleeve having an upper section and a lower section, the upper section having a first opening for receiving the tip end of the shaft and the lower section having a second opening with a threaded internal surface, the sleeve connected to the tip end of the shaft;

a tube having an anti-rotation portion, the tube having an opening for receiving the sleeve;

a mechanical fastener; and an o-ring, wherein the tube is formed separately from the hosel and secured within the hosel;

wherein the mechanical fastener is inserted through the sole opening and into the tube, and engages the threaded internal surface of the second opening in the sleeve lower section;

wherein the o-ring prevents the mechanical fastener from leaving the tube;

wherein the o-ring is located proximate the tube and the sleeve when the golf club is fully assembled; and wherein the first opening of the sleeve has an axis S that is off-angle from an axis L of the lower section of the sleeve and off-angle with an axis of the internal hosel of the golf club head, allowing for the effective loft, lie and face angle of the golf club to be adjusted by rotation of a subassembly of the shaft and sleeve.

2. The golf club of claim 1 wherein the sleeve is composed of a metal material.

3. The golf club of claim 1 wherein the sleeve is composed of an aluminum alloy.

4. The golf club of claim 1 wherein the sleeve is composed of a titanium alloy.

5. The golf club of claim 1, wherein the sleeve is composed of a composite material.

6. The golf club of claim 1, wherein the lower section of the sleeve has an exterior surface with a keyed portion that is complementary to and mates with the anti-rotation portion of the tube.

7. The golf club of claim 6, wherein the keyed portion has a splined configuration.

* * * * *